US005494226A

United States Patent [19]

Herstek et al.

[11] Patent Number: 5,494,226

[45] Date of Patent: Feb. 27, 1996

[54] SPLINED CARBIDE NOZZLE

[75] Inventors: Glen Herstek; Tom Jenkins, both of Lorain, Ohio

[73] Assignee: Nordson Corporation, Westlake, Ohio

[21] Appl. No.: 194,482

[22] Filed: Feb. 10, 1994

[51] Int. Cl.[6] ..... B05B 1/00

[52] U.S. Cl. ..... 239/591; 239/600

[58] Field of Search ..... 403/282, 359; 29/890.143, 890.142, 8; 277/213, 215, 207 A; 239/600, 591, 590, 590.3, 597

[56] References Cited

U.S. PATENT DOCUMENTS

| | | | |
|---|---|---|---|
| 2,139,745 | 4/1937 | Goodall | 285/80 |
| 3,032,357 | 5/1962 | Shames et al. | 239/588 X |
| 3,848,901 | 11/1974 | Hoffman | 285/137 R |
| 3,947,940 | 4/1976 | Augustine . | |
| 4,118,134 | 10/1978 | Mansel . | |
| 4,139,160 | 2/1979 | Rood . | |
| 4,346,849 | 8/1982 | Rood . | |
| 4,349,947 | 9/1982 | Rood . | |
| 4,355,764 | 10/1982 | Rood et al. . | |
| 4,501,394 | 2/1985 | Kwok . | |
| 4,736,892 | 4/1988 | Calder | 239/600 X |
| 4,915,069 | 4/1990 | LaFever et al. | 277/215 X |
| 4,964,573 | 10/1990 | Lipski | 239/588 X |
| 5,060,869 | 10/1991 | Bekius | 239/600 X |
| 5,074,025 | 12/1991 | Willard, III . | |
| 5,143,302 | 9/1992 | Sakuma | 239/599 |

*Primary Examiner*—Andres Kashnikow
*Assistant Examiner*—Kevin Weldon
*Attorney, Agent, or Firm*—Howard M. Cohn

[57] ABSTRACT

A spray nozzle assembled from a nozzle tip of a hard abrasive resistant material and having a plurality of splines about an outer peripheral surface being press-fit into a nozzle adapter formed of a softer, more machineable material to mechanically lock and form a liquid seal between the nozzle tip and the nozzle adapter.

12 Claims, 1 Drawing Sheet

SPLINED CARBIDE NOZZLE

FIELD OF THE INVENTION

This invention relates to an apparatus for spraying paints, lacquers, and similar coating materials and to a method of manufacturing such apparatus. More particularly, this invention relates to a spray nozzle and method of manufacturing the spray nozzle.

BACKGROUND OF THE INVENTION

Spray nozzles are generally used to atomize liquids. One conventional type of nozzle, generally characterized as an "airless" spray nozzle, is used in conjunction with airless spray equipment to force the paint stream through a small orifice under a relatively high pressure, as for example, a pressure on the order of about 300 to 3,000 psi. As the paint is propelled through the small orifice, it is broken up or atomized into very fine droplets. The paint spray dispensed from the orifice then moves at a relatively low velocity toward the article to be painted. Typically, the paint spraying operation is carried out with the atomized paint particles charged to a relatively high electrostatic potential and with the workpiece or article to be coated at, or close to, ground potential. The particles are then additionally urged toward the workpiece by the forces of the electrostatic field. This airless type of spraying has the recognized advantage of providing a very high deposition efficiency, i.e., a large portion of the paint spray emitted from the gun is effectively deposited on the article to be coated. Airless spray nozzles are also used for non-electrostatic applications.

A characteristic of many paints is that they contain a substantial portion of abrasive materials. In the course of passage through the nozzle orifice at a relatively high pressure, as in the airless spray systems, paints tend to wear or abrade away the nozzle orifice. Consequently, the nozzle orifice is usually formed in a nozzle tip made from a material having a high resistance to abrasion. Such a tip is commonly manufactured from a very hard material, as for example, tungsten carbide. Even when manufactured from a very hard material, the nozzle tips are subject to wear and must be regularly replaced. Being a replaceable item, the nozzles are therefore manufactured as inexpensively as possible.

One common expedient for minimizing the cost of the nozzle is to manufacture the nozzle in two pieces, one a small nozzle tip of very hard, abrasive resistant, material and the other a more easily machined, less expensive but less abrasive resistant nozzle mount. This nozzle mount, within which the nozzle tip is mounted, is commonly referred to as a nozzle adapter.

In the past, it has been common practice to mount the nozzle tip within the nozzle adapter by brazing the tip to the adapter. The adapter was then secured to a nozzle assembly of a spray gun by a conventional threaded connection, which secured the nozzle tip in a fixed position relative to the nozzle assembly.

When used in high pressure airless spray systems, there has been a sporadic but recurring problem as a consequence of brazing failures between the nozzle and nozzle adapter. Upon failure of the brazed joint, the nozzle tip of an airless spray nozzle may be blown from the nozzle adapter toward the workpiece at a relatively high velocity with the result that it may ricochet off the workpiece or spray booth and cause a hazard to nearby personnel. A nozzle adapter having lips for mechanically locking the tip in the adapter, as discussed in U.S. Pat. No. 4,349,947, assigned to Nordson Corp., the assignee of the present invention, which patent is incorporated in its entirety herein, is one means of overcoming this problem. However, the machining and assembly requirements make this design relative expensive to manufacture.

OBJECTS AND SUMMARY OF THE INVENTION

It is an object of the present invention to provide a spray nozzle constructed of a nozzle tip securely mounted in an nozzle adapter to obviate the problems and limitations of the prior art systems.

It is a further object of the present invention to provide a spray nozzle in which the nozzle tip has a splined section for quick and easy assembly of the nozzle tip in the nozzle adapter.

Yet another object is to provide an improved spray nozzle with accurate axial alignment between the nozzle tip and nozzle adapter.

In accordance with the invention, there is provided a spray nozzle comprising a nozzle adapter having a cylindrical body through which extends an axial bore that is stepped and includes a bored rearward end section and a generally smaller bored forward end section. A nozzle tip is securely mounted within the nozzle adapter. The nozzle tip has a cylindrical mounting section with a plurality of parallel splines disposed about the external peripheral surface. The mounting section terminates with a base section at one end and with a spherical dome shaped section at the other end. The nozzle tip is press-fit into the nozzle adapter whereby the splines are in sealing engagement with the circumferential surface of the axial bore within the forward end section and the base section is located within the bored rearward end section. The nozzle tip is made from a very hard, abrasive resistant material and the nozzle tip adapter is made from a material which is not as hard as the material of the nozzle tip. Thus, when the nozzle tip is press fit into the nozzle adapter, the interior surface of the bored forward end section of the adapter is deformed by the splines to create an hydraulic seal and permanently attach the nozzle tip to the nozzle adapter.

Also in accordance with this invention, a seal washer is seated within the bored rearward end section against a surface formed by the intersection of the bored rearward end section and the bored forward end section to prevent leakage of liquid between the nozzle tip and the nozzle adapter.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
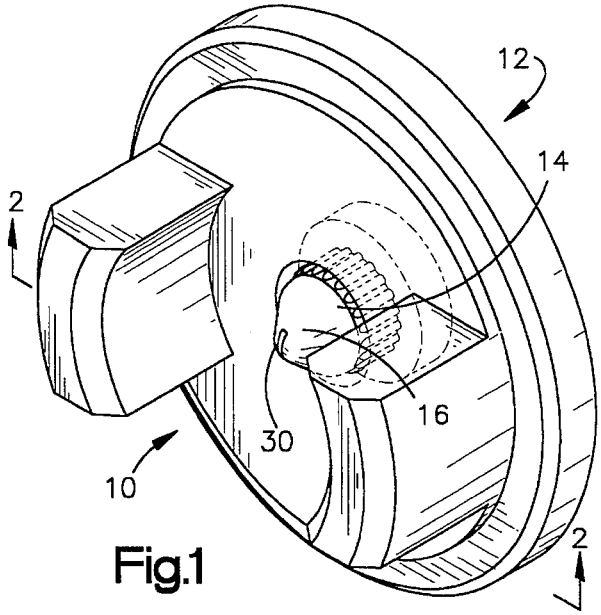
FIG. 1 is a front perspective view of a spray nozzle incorporating the present invention.
Figure 2:
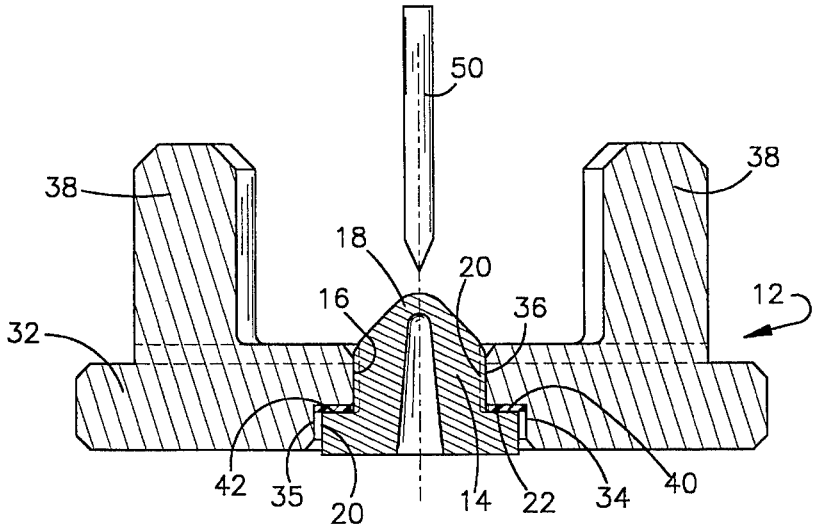
FIG. 2 is a cross sectional view taken through line 2—2 of FIG. 1.

Referring to FIGS. 1 and 2, there is illustrated an assembled airless spray nozzle 10 incorporating the present invention. Nozzle 10 comprises a nozzle adapter 12 and a nozzle tip 14 made from a very hard, abrasive resistant material such as ceramic or sintered, tungsten carbide. This type of material is chosen because paints, lacquers, and other liquids which contain abrasive solids in suspension are commonly sprayed through spray nozzle 10 at high pressures in the order of between about 300 and 3,000 psi. These sprayed materials tend, in the course of passage through the nozzle, to abrade away the nozzle tip. To minimize the abrasive corrosion, very hard abrasive resistant materials are chosen for the nozzle tips. These materials are relatively expensive and difficult to machine. Accordingly, nozzle tip 14 is made as small as possible and mounted within an adapter 12 which is constructed of a material that is more easily machineable and less expensive. One adapter material which is commonly chosen for these properties as well as its resistance to corrosion is stainless steel.

Figure 3:
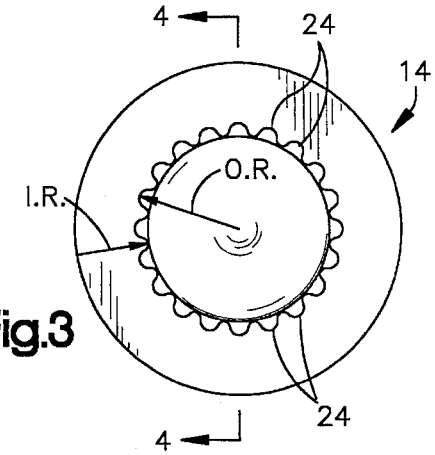
FIG. 3 is a plan view of a nozzle tip in accordance with the present invention.
Figure 4:
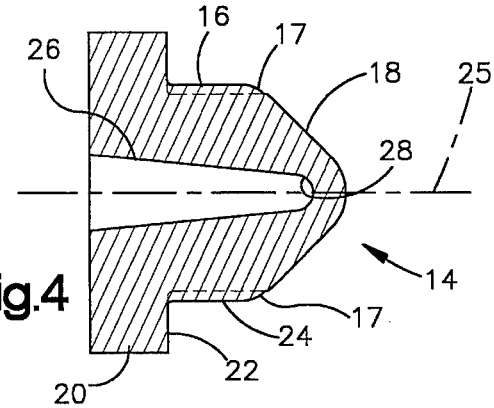
FIG. 4 is a cross sectional view taken through line 4—4 of FIG. 3.

Nozzle tip 14, as illustrated in FIGS. 2, 3, and 4, comprises a generally cylindrical mounting section 16 terminating at one end with a semi-spherical dome shaped end 18 and at the other end with a cylindrical base section 20. Base section 20 has a larger diameter than mounting section 16 and forms a circular surface 22 at the intersection with section 16. A plurality of splines 24 are evenly disposed about the external peripheral surface of mounting section 16. Splines 24 are in parallel relation to each other and coaxial with a centerline 25 through mounting section 16. The free ends 17 of each spline 24 are beveled. In the preferred embodiment, there are 20 splines and each spline has an outside radius (O.R.) of about 0.002 to 0.005 inches and an inside radius (I.R.) at the root of about 0.002 to about 0.005 inches. While 20 splines 24 are illustrated, it is within the terms of the invention to use more or less splines with different inside and outside radiuses, as desired.

Within nozzle tip 14 is a slightly tapered approach passage 26 which terminates in a generally semi-spherical blind recess 28. After assembly of tip 14 into nozzle adapter 12 and securement therein, as explained more fully hereinafter, approach passage 26 is opened by grinding of an outlet orifice 30 (as seen in FIG. 1) through the dome shaped end 18 of the tip.

The nozzle adapter 12, as seen in FIGS. 1 and 2, comprises a generally cylindrical body 32 through which there extends an axial bore 34. Bore 34 is stepped and comprises a bored rearward end section 35 and a generally smaller bored, forward end section 36. On the forward face of adapter 12 is a pair of spaced ears 38 which function to protect the nozzle tip 14 against inadvertent contact with foreign objects. Quite commonly, nozzle 10 is mounted in a manually operated spray gun (not shown) with which it is not uncommon for the operator to move in such a way that the relatively fragile carbide nozzle tip accidentally contacts a workpiece or other foreign object and becomes damaged. To avoid such accidental damage to the fragile carbide nozzle tip, ears 38 extend forwardly on opposite sides of tip 14.

The outer diameter of cylindrical mounting section 18 of nozzle tip 14 is larger, in the order of approximately 0.002 inches to about 0.005 inches, than the inside diameter of forward end section 36 of nozzle adapter 12. Prior to assembling nozzle tip 14 within nozzle adapter 12, a seal 40, such as a nylon or teflon washer, is inserted into rearward bore 35 and seated against a surface 42 formed at the intersection of bores and 36. The seal 40 may or may not be provided. Next, nozzle tip 14 is pressed into the nozzle adapter 12 so that splines 20 are in compressive engagement with the circumferential surface forming bore 36 of adapter 12. The beveled ends 17 of splines 20 allow nozzle tip 14 to be more easily inserted into the rearward facing opening of bore 36. Because the carbide material forming the nozzle tip 14 is harder than the material of adapter 12, the surface of bore 35 deforms and forms a seal with nozzle tip 14 while permanently attaching the nozzle tip to nozzle adapter 12. Thus, the nozzle tip is held and sealed into the nozzle adapter by only mechanical friction, but without undue forces being applied to nozzle tip 14. During the assembly procedure, external circular surface 22, at the intersection of cylindrical sections 16 and 20, presses seal 40, when present, against surface 42 at the intersection of bores 35 and 36 to prevent any leakage through axial bore 34. In addition, the press-fit insures accurate axial alignment between nozzle tip 14 and nozzle adapter 16.

The nozzle adapter and tip, at this stage, are completely assembled and ready for machining the outlet orifice 30 into nozzle tip 14. This is commonly accomplished by passage of a diamond surfaced cutter grinder wheel 50 through the dome shaped end 18 of the tip. The machining of this nozzle orifice is critical to the proper size and functioning of the nozzle. To that end the nozzle assembly is commonly mounted in a special grinding fixture (not shown) and the cutter grinding wheel 50 passed between ears 38 to machine the generally elongated orifice 30 from the dome.

After assembly, nozzle 10 is secured to the end of a spray gun (not shown) by any conventional means such as a retaining nut to provide fluid communication with the fluid under pressure through nozzle tip 14.

It is apparent that there has been provided in accordance with this invention a spray nozzle constructed of a nozzle tip and a nozzle adapter that satisfies the objects, means and advantages set forth hereinbefore. According to the invention, the splined section of a nozzle tip, formed of a very hard, abrasive resistant material, is press-fit into a nozzle adapter formed of a softer, more machineable material to mechanically lock and form a liquid seal between the nozzle tip and the adapter.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A spray nozzle, comprising:

a nozzle adapter having an axial bore therethrough; and a nozzle tip having a cylindrical mounting section with a plurality of parallel splines disposed about an outer peripheral surface thereof, said nozzle tip being press-fit into said nozzle adapter so that said splines are in frictional engagement with a circumferential inner surface of said axial bore through said nozzle adapter to secure said nozzle tip to said nozzle adapter, said splines deforming said circumferential inner surface of said axial bore to create a seal between said nozzle tip and said nozzle adapter.

2. The spray nozzle of claim 1 wherein said nozzle tip is of a very hard, abrasive resistant material and said nozzle adapter is of a corrosive resistant material which is softer than the material of said nozzle tip.

3. The spray nozzle of claim 2, wherein said nozzle tip is of a material selected from the group consisting essentially of ceramic and sintered tungsten carbide.

4. The spray nozzle of claim 1 wherein said cylindrical mounting section of said nozzle tip terminates with a semi-spherical dome shaped end section at one end and a cylindrical base section at the opposite end, wherein said base section has a larger diameter than said mounting section.

5. The spray nozzle of claim 4 wherein said nozzle tip has a slightly tapered approach passage which terminates in a generally semi-spherical blind recess forming an interior of said nozzle tip.

6. The spray nozzle of claim 4 wherein said nozzle adapter includes a generally cylindrical body portion having an axial stepped bore therethough, said axial stepped bore having a rearward end section forming a first inner circumferential surface with a first inside diameter and a forward end section forming a second inner circumferential surface with a second inside diameter being smaller than said first inside diameter.

7. The spray nozzle of claim 6 wherein an outer diameter of said cylindrical mounting section between outer edges of said splines on opposite sides of said cylindrical mounting section is larger than said second inside diameter of said circumferential inner surface of said forward end section of said nozzle adapter whereby when said nozzle tip is press-fit into said nozzle adapter, said splines are in compressive engagement with said second circumferential inner surface of said forward end section of said adapter whereby said second circumferential inner surface of said axial bore in said forward end section of said adapter deforms to mechanically attach and seal said nozzle tip to said nozzle adapter.

8. The spray nozzle of claim 7 further including a washer seated within said axial bore extending through said nozzle adapter against a surface at the intersection of said rearward end section and said forward end section to prevent leakage between said nozzle tip and said nozzle adapter.

9. A spray nozzle tip, comprising:

a nozzle tip having a cylindrical mounting section with a plurality of splines disposed about an outer peripheral surface thereof adapted for sealing engagement with a nozzle adapter, said cylindrical mounting section terminating in semi-spherical dome shaped end section at one end and in a cylindrical base section at the opposite end, wherein said base section has a larger outer diameter than an outer diameter of said cylindrical mounting section.

10. The spray nozzle tip of claim 9 wherein said nozzle tip has a slightly tapered approach passage which terminates in a generally semi-spherical blind recess forming an interior of said nozzle tip.

11. The spray nozzle tip of claim 10 wherein said nozzle tip is of a very hard, abrasive resistant material.

12. The spray nozzle tip of claim 10 wherein said nozzle tip is of a material selected from the group consisting essentially of ceramic and sintered tungsten carbide.

* * * * *